US006247193B1

(12) United States Patent
Riepl

(10) Patent No.: US 6,247,193 B1
(45) Date of Patent: Jun. 19, 2001

(54) FLUSH TOILET WITH RIM NOZZLES

(76) Inventor: Josef Riepl, Regin 4, Feldkirchen (AT)

( * ) Notice: Subject to any disclaimer, the term of this patent is extended or adjusted under 35 U.S.C. 154(b) by 0 days.

(21) Appl. No.: 09/639,786

(22) Filed: Aug. 16, 2000

(30) Foreign Application Priority Data

Aug. 19, 1999 (AT) ..... A1426/99

(51) Int. Cl.[7] ..... E03D 11/02; E03D 11/08
(52) U.S. Cl. ..... 4/420; 4/421; 4/432
(58) Field of Search ..... 4/420, 421, 432, 4/420.4, 420.5, 433

(56) References Cited

U.S. PATENT DOCUMENTS

| | | | | |
|---|---|---|---|---|
| 270,113 | * | 1/1883 | Pike | 4/420 |
| 705,319 | * | 7/1902 | Bush | 4/420 |
| 2,050,152 | * | 8/1936 | Beam | 4/421 |
| 2,282,636 | | 5/1942 | Bennett . | |
| 4,404,696 | * | 9/1983 | Heinze et al. | 4/420 |
| 4,559,650 | | 12/1985 | Pruckner . | |
| 5,692,250 | * | 12/1997 | Oldfelt et al. | 4/432 |
| 5,909,968 | * | 6/1999 | Olin et al. | 4/420 |

FOREIGN PATENT DOCUMENTS

| | | | | |
|---|---|---|---|---|
| 43 19 304 | | 11/1993 | (DE) . | |
| 4321559 A1 | * | 1/1995 | (DE) | 4/431 |
| 5-230863 | * | 9/1993 | (JP) | 4/420 |
| WO 99/27203 | | 3/1999 | (WO) . | |

* cited by examiner

*Primary Examiner*—Charles R. Eloshway
(74) *Attorney, Agent, or Firm*—Herbert Dubno; Andrew Wilford

(57) ABSTRACT

A flush toilet has a housing and a bowl set in the housing, having an upper rim, and having an inner surface extending downward from the rim. A ring atop the bowl has a plurality of nozzles spaced about the rim and each directed at an acute angle against an immediately adjacent portion of the inner bowl surface. Respective conduits have outer ends connected to the nozzles and inner ends. A supply feeds water under pressure to the inner ends and thereby directs streams of water from the nozzles against the inner surface. The conduits are all of substantially the same length between their ends so that pressure at the nozzles is uniform. These conduits are at least partially formed by flexible tubes. In addition each nozzle has an oval-shaped outlet opening and is directed at an acute angle of between 10° and 20° against the respective adjacent bowl portion and also at an angle of between 20° and 40° to vertical.

3 Claims, 4 Drawing Sheets

FLUSH TOILET WITH RIM NOZZLES

FIELD OF THE INVENTION

The present invention relates to a flush toilet. More particularly this invention concerns a flush toilet having a system for directing streams of water into the bowl from the bowl's rim.

BACKGROUND OF THE INVENTION

A standard flush toilet has a housing in which is set a bowl that is unitarily formed with a trap outlet. A nozzle ring is provided around the upwardly open mouth of the bowl to direct a plurality of streams of water straight down into the bowl. The incoming water causes the outlet to overflow and the resultant draining action, often augmented by a siphon effect, empties the bowl.

The nozzle ring is typically built into the cover or top part of the toilet and comprises an annular manifold passage fed at one location with water under pressure and having a plurality of outlets forming the nozzles. The nozzles furthest from the feed location are not in this system highly effective because they get little pressure, while those close to the feed location emit relatively powerful streams.

OBJECTS OF THE INVENTION

It is therefore an object of the present invention to provide an improved flush toilet.

Another object is the provision of such an improved flush toilet which overcomes the above-given disadvantages, that is which flushes uniformly and quietly while using a minimum of water.

SUMMARY OF THE INVENTION

A flush toilet has according to the invention a housing and a bowl set in the housing, having an upper rim, and having an inner surface extending downward from the rim. A ring atop the bowl has a plurality of nozzles spaced about the rim and each directed at an acute angle against an immediately adjacent portion of the inner bowl surface. Respective conduits have outer ends connected to the nozzles and inner ends. A supply feeds water under pressure to the inner ends and thereby directs streams of water from the nozzles against the inner surface.

According to further features of the invention the conduits are all of substantially the same length between their ends so that pressure at the nozzles is uniform. These conduits are at least partially formed by flexible tubes. In addition each nozzle has an oval-shaped outlet opening.

Each nozzle is directed at an acute angle of between 10° and 20° against the respective adjacent bowl portion and also at an angle of between 20° and 40° to vertical. Thus the nozzles create an angled swirling flow along the bowl surface.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
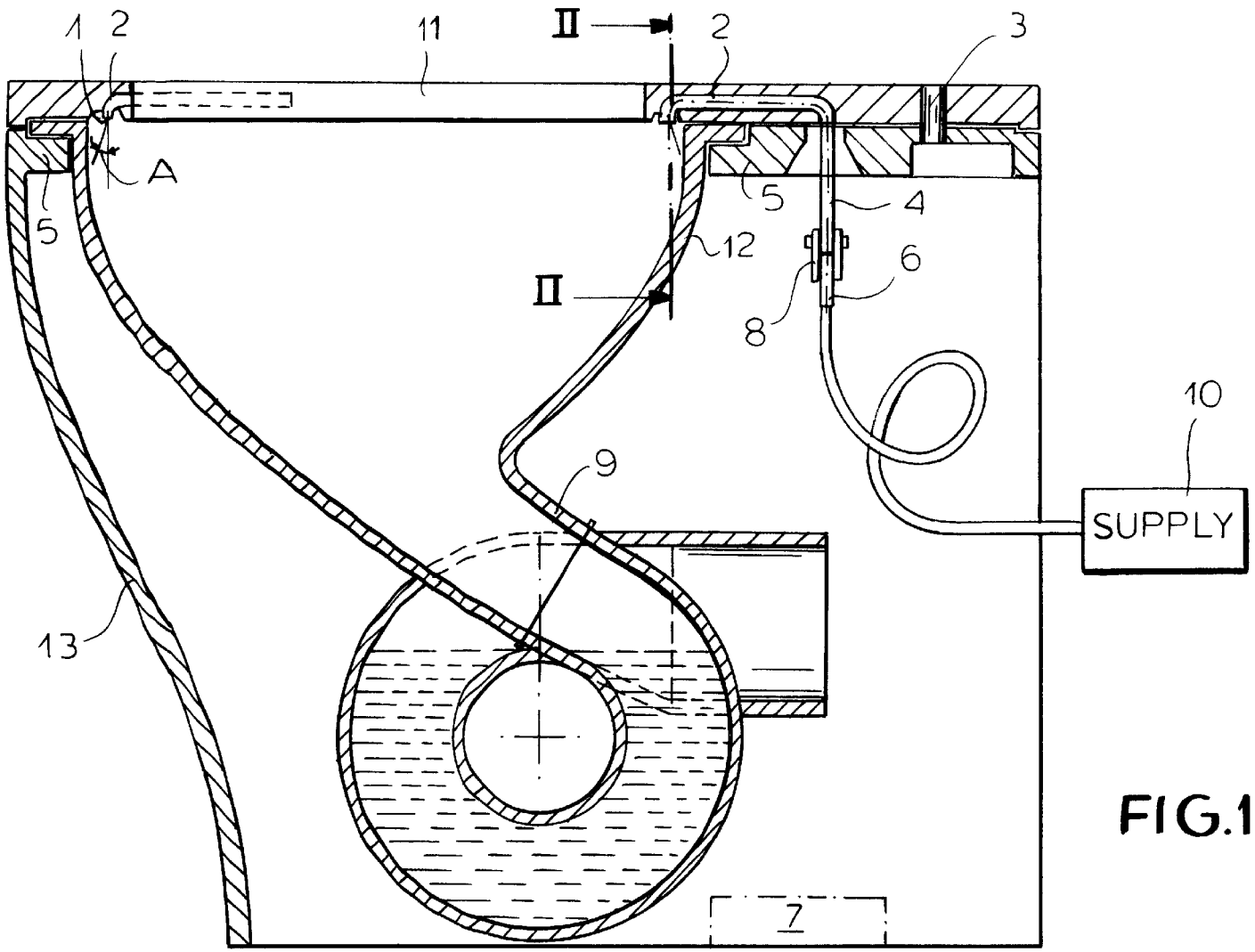
FIG. 1 is a partly diagrammatic vertical section through the toilet according to the invention.
Figure 2:
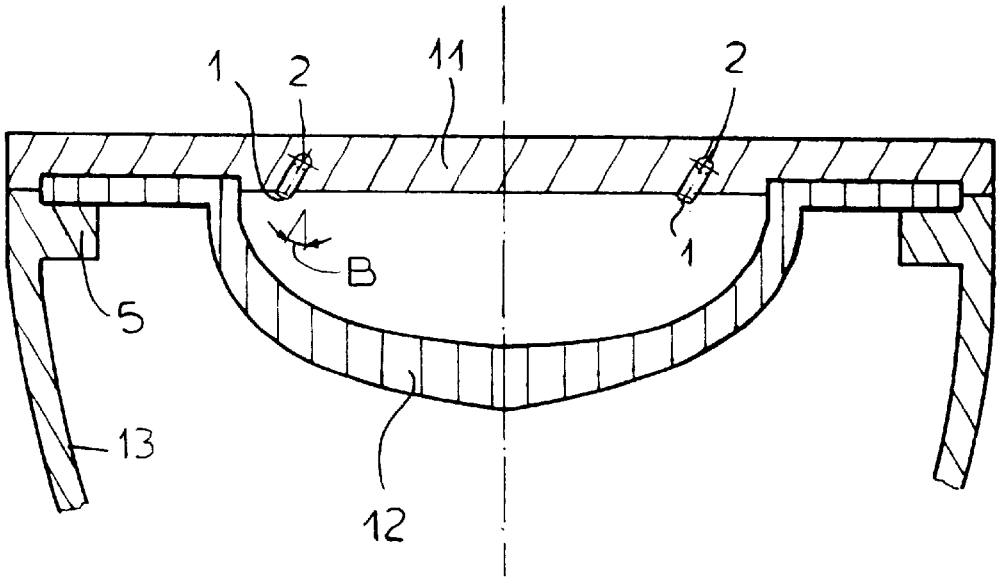
FIG. 2 is a section taken along line II—II of FIG. 1.
Figure 4:
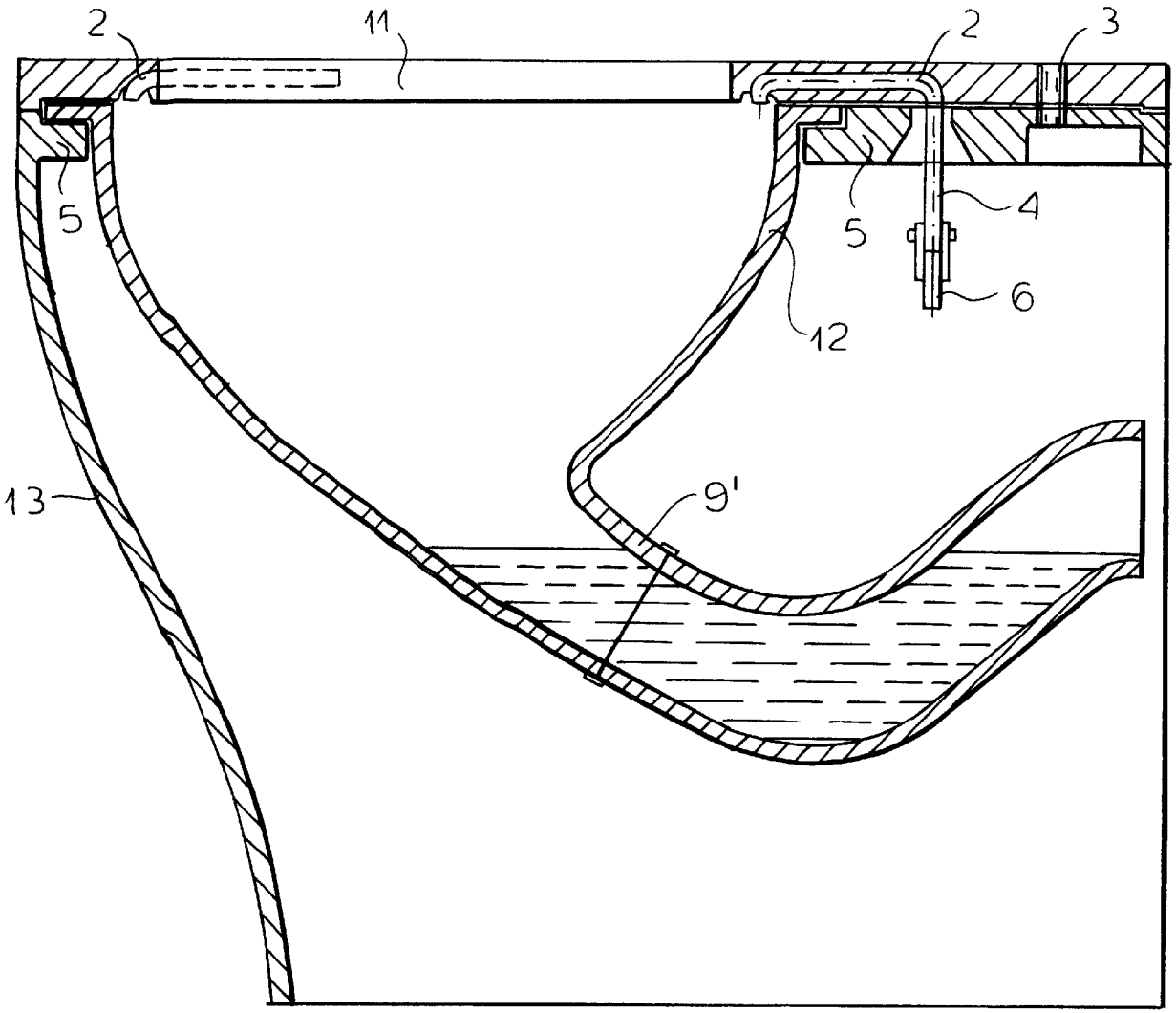
FIG. 4 is a view like FIG. 1 of an alternative bowl according to the invention.

As seen in FIGS. 1 and 2 a flush toilet according to the invention basically comprises a housing 13 secured to the floor at 7 and formed with mounting holes 3 for attachment of a lid. A one-piece plastic or ceramic bowl 12 sits on a rim 5 of the housing 13 and is formed with a spiral-shaped water seal or outlet trap 9. FIG. 4 shows how, instead, a standard U-shaped water seal or outlet trap 9' can be used.

Figure 3:
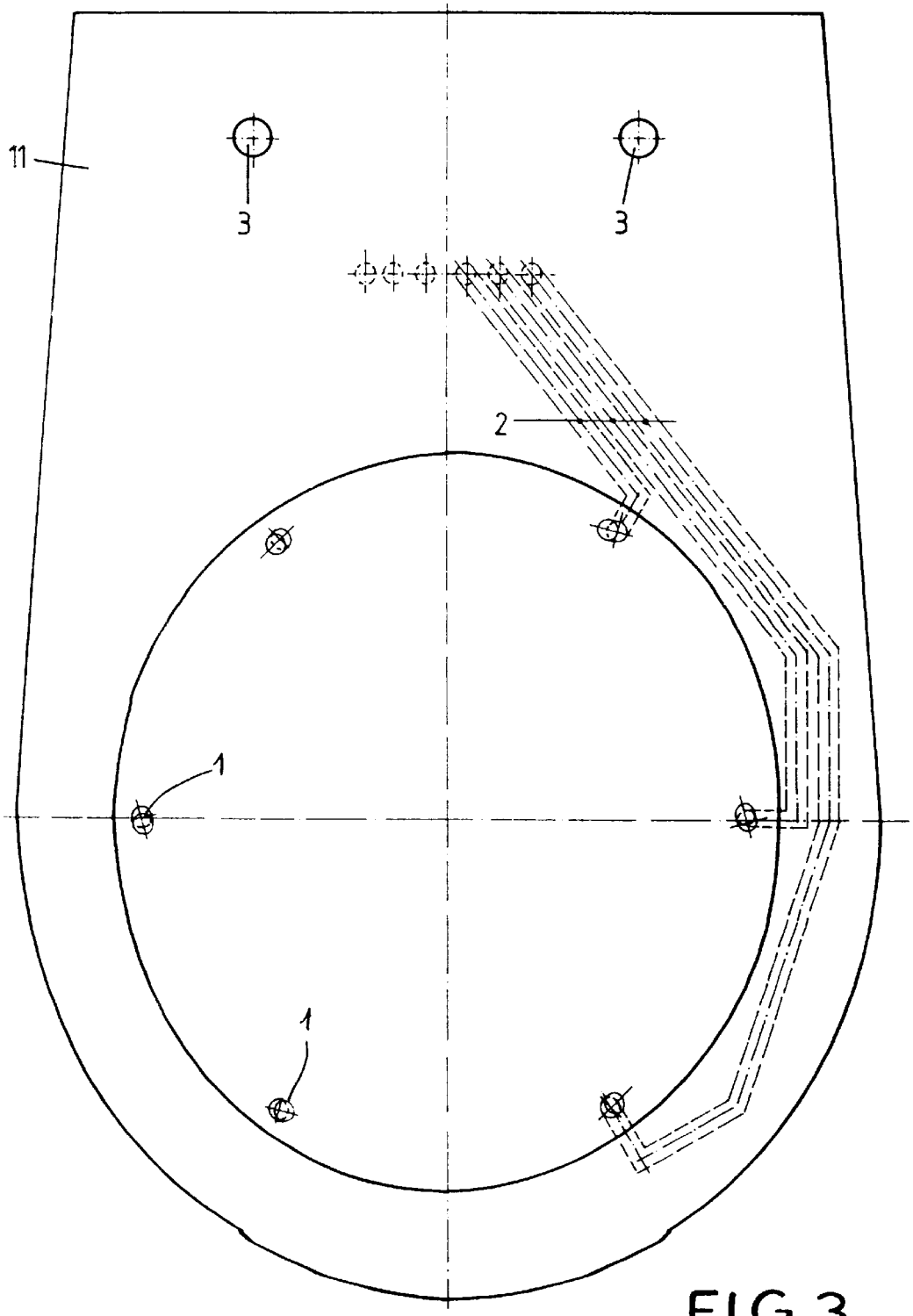
FIG. 3 is a bottom view of the nozzle ring according to the invention.

According to the invention and as shown in FIG. 3 a ring 11 sitting atop the bowl 12 has an annular array of six circumferentially equispaced oval nozzles 1 directed down into the bowl 12. The nozzles 1 are at the ends of respective conduit passages 2 in the ring 11. Ends 4 of these conduits 2 are connected via fittings 8 to further conduits 6 connected to a supply 10 of water under pressure. The conduits 4 and 6 of each nozzle 1 are of the same length, that is those nozzles 1 closer to the supply 10 have longer tubes 6 and vice versa. Thus the pressure at each nozzle 1 will be the same.

As shown in FIGS. 1 and 2 the nozzles 1 are directed at an acute angle A of about 15° to the immediately adjacent vertical inner surface of the upper region of the bowl 12, and are angled at am acute angle B of about 30° so that the water streams they emit flow downward in a spiral. Such angling of the nozzles 1 ensures that they thoroughly scour the inner face of the bowl 12, whose outlet 9 is constructed so that no open water is exposed upward in the bowl, preventing any splashing.

With the system of this invention it is possible to flush clean with only 1.5 to 2.5 liter of water, and a large flush of 3 to 5 liter will thoroughly scour the bowl 12. A pressure of only 2 bar is sufficient for such efficient operation.

I claim:

1. A flush toilet comprising:

a housing;

a bowl set in the housing, having an upper rim, and having an inner surface extending downward from the rim;

a ring atop the bowl having a plurality of nozzles spaced about the rim and each directed against an immediately adjacent respective portion of the inner bowl surface at an acute angles to the respective adjacent portion;

respective conduits having outer ends connected to the nozzles and inner ends, each of the conduits being formed by a passage formed in the ring and terminating at the respective outer end and by a respective flexible tube extending between the respective passage and the respective inner end, the passages being of different lengths; and means including a water supply for feeding water under pressure to the inner ends and thereby directing streams of water from the nozzles against the inner surface, the flexible tubes being of such lengths that the overall lengths of the conduits between their inner and outer ends are all substantially equal, whereby pressure at the nozzles is uniform.

2. The flush toilet defined in claim 1 wherein each nozzle has an oval-shaped outlet opening.

3. The flush toilet defined in claim 1 wherein each nozzle is directed at an acute angle of between 10° and 20° against the respective adjacent bowl portion and also at an angle of between 20° and 40° to vertical, whereby the nozzles create an angled swirling flow along the bowl surface.

* * * * *